United States Patent [19]

Marchetti

[11] Patent Number: 4,883,232

[45] Date of Patent: Nov. 28, 1989

[54] ADHESIVE TAPE FEEDER, PARTICULARLY FOR A CARDBOARD BOX SEALING MACHINE TAPING UNIT

[76] Inventor: Augusto Marchetti, Piazza Sicilia, 7,. 20146 Milano, Italy

[21] Appl. No.: 93,144

[22] Filed: Sep. 2, 1987

Related U.S. Application Data

[63] Continuation of Ser. No. 765,157, Aug. 13, 1985, abandoned.

[30] Foreign Application Priority Data

Oct. 17, 1984 [IT] Italy ..... 23545/84[U]

[51] Int. Cl.[4] ..... B65H 19/04

[52] U.S. Cl. ..... 242/55.2; 242/75.4; 226/190

[58] Field of Search ..... 226/186, 190, 127; 242/75.4, 75, 75.45, 55.2, 156.1

[56] References Cited

U.S. PATENT DOCUMENTS

| | | | |
|---|---|---|---|
| 1,409,505 | 3/1922 | Wheildon | 242/75.45 |
| 1,676,797 | 7/1928 | Nyman | 242/75.45 |
| 1,854,004 | 4/1932 | Tschopp | 226/179 |
| 2,788,944 | 4/1957 | Krueger | 242/55.2 |
| 3,081,014 | 3/1963 | Anderson et al. | 242/75.2 X |
| 3,123,271 | 3/1964 | Johnson | 226/186 |
| 3,482,800 | 12/1969 | Barnett et al. | 242/75.4 X |

*Primary Examiner*—Stuart S. Levy
*Assistant Examiner*—Katherine Matecki
*Attorney, Agent, or Firm*—Cushman, Darby & Cushman

[57] ABSTRACT

A supporting arm supports a freely rotatable roller, on which a roll of adhesive tape is mounted. A tape withdrawal roller, rotatably mounted on a lever arm, is resiliently held in tangential contact with the perimeter of the roll.

2 Claims, 4 Drawing Sheets

ADHESIVE TAPE FEEDER, PARTICULARLY FOR A CARDBOARD BOX SEALING MACHINE TAPING UNIT

This is a continuation of application Ser. No. 765,157, filed Aug. 13, 1985, now abandoned.

BACKGROUND OF THE INVENTION

1. Field of the Invention

The present invention relates to an adhesive tape feeder, particularly for a cardboard box sealing machine taping unit.

2. Description of the Related Art

Taping units and in general all those devices which use adhesive tape comprise a feeder which continuously supplies adhesive tape to the appropriate operating members.

A basic part of said feeder is a roll of adhesive tape which is supported in a freely revolving manner by arms which are integral with the taping unit. From said roll the tape is progressively unwound, overcoming the resistance of the adhesive side of said tape, which naturally tends to remain attached to the rest of the roll.

A problem of said feeders is to ensure constant resistance to withdrawal at all times and with any roll diameter (decreasing as the operation proceeds), avoiding those alternations of tightening and loosening of the tape, which can be the source of breakage or irregular operation of the taping unit.

Another problem is to ensure perfect centering of the fed tape despite any possible convexity and/or misalignment of the starting roll.

SUMMARY OF THE INVENTION

The object of the present invention is to provide an adhesive tape feeder which ensures the desired conditions of resistance to withdrawal and perfect centering of the supplied roll.

To achieve said object the feeder according to the invention, which comprises a supporting arm for a freely rotating roller for the support of a roll of adhesive tape is characterized first in that it includes, in addition a tape withdrawal roller mounted in a revolving manner on a supporting arm flexibly stressed in such a manner as to hold said withdrawal roller in tangential contact with the perimeter of said roll.

It is clear that with a withdrawal roller in constant tangential contact with the adhesive tape roll, resistance to withdrawal is not subject to variation, neither depending on any possible oscillations in the resistance of the roll (braked by the withdrawal roller) nor as a function of the progressively decreasing diameter of said roll. It depends exclusively on the angle of withdrawal, which is made constant by passage of the tape around the withdrawal roller while being engaged with said withdrawal roller. Uniform withdrawal and uniform tensioning of the tape as desired are thus assured.

In accordance with the invention it is also provided that the withdrawal roller be fitted with sides for centering the tape and that the roll supporting roller be capable of limited axial sliding.

In this manner the tape withdrawn is perfectly centered and the roll and its supporting roller can constantly adapt themselves to the centered position of the withdrawal roll, compensating with limited axial sliding of the supporting roller any possible convexities and misalignments of the roll.

It is provided optionally that the withdrawal roller be equipped with an appropriately adjustable brake. This could be useful to ensure a desired tensioning of the tape downstream from the withdrawal roller.

BRIEF DESCRIPTION OF THE DRAWINGS

The features of the present invention will be made clearer by the following detailed description of a practical embodiment thereof illustrated as an example in the annexed drawings wherein.

DETAILED DESCRIPTION OF THE PREFERRED EMBODIMENTS

Figure 1:
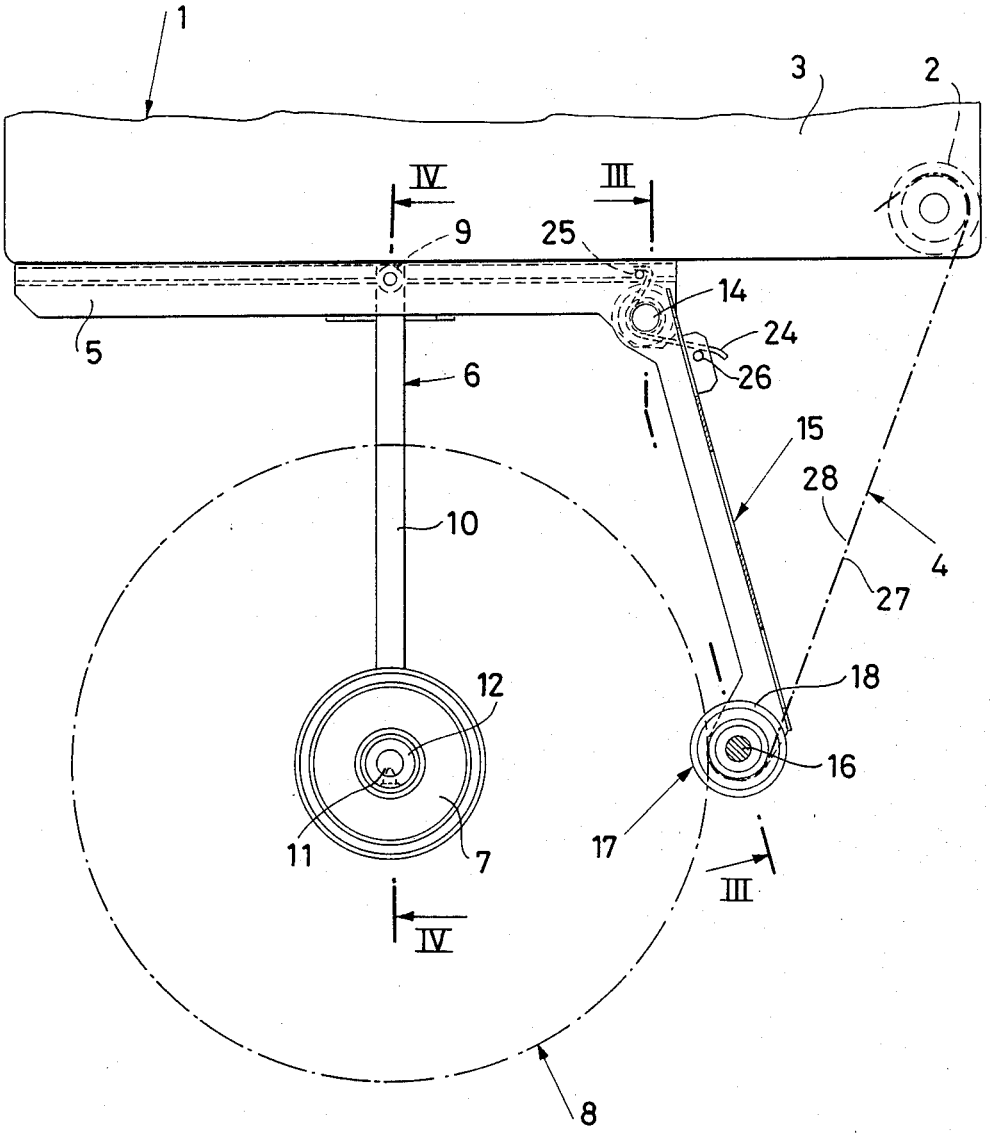
FIG. 1 shows a side view of a taping unit feeder in accordance with the present invention.
Figure 2:
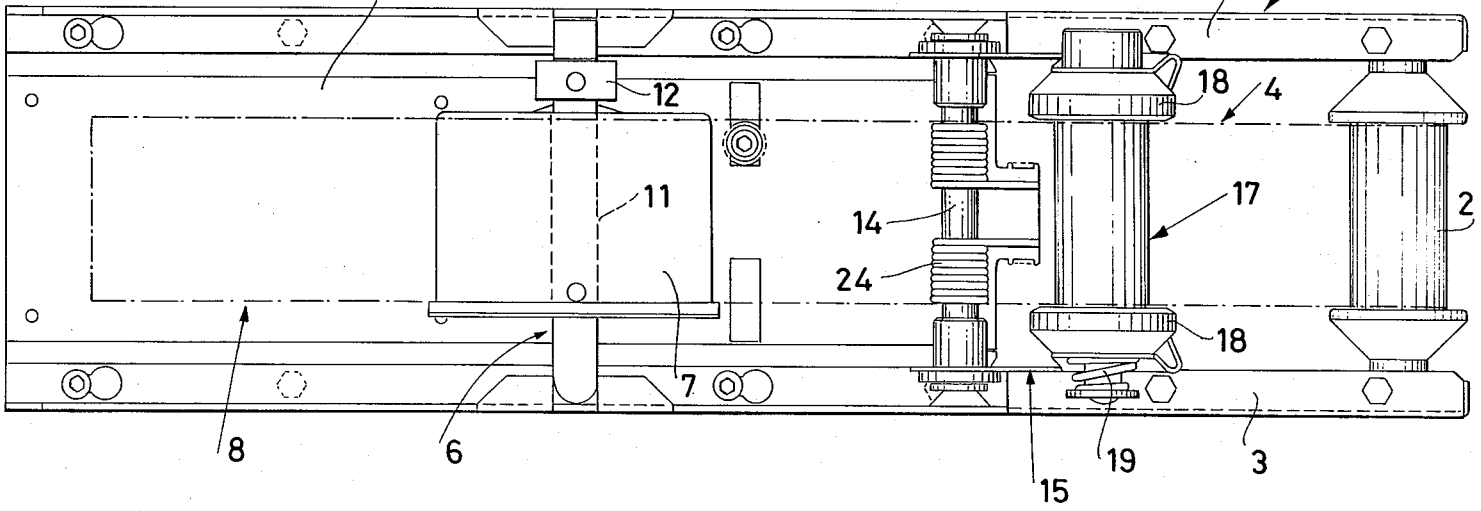
FIG. 2 shows said feeder in plan view from below.

With reference to the drawings a feeder in accordance with the invention is shown as an example applied to the base of a cardboard box-closing machine taping unit 1. Of said taping unit, FIG. 1 shows only an idling roller 2 mounted in a revolving manner between two sides 3 (FIG. 2) with which is engaged the tape 4 at its inlet into the taping unit 1. It is evident that the construction and the manner of operation of the taping unit or of another device which may replace it are not binding for the purposes of the features of the present invention, just as is not binding the fact that the taping unit shown in the drawings is provided as a lower taping unit rather than as an upper taping unit of a sealing machine.

Figure 3:
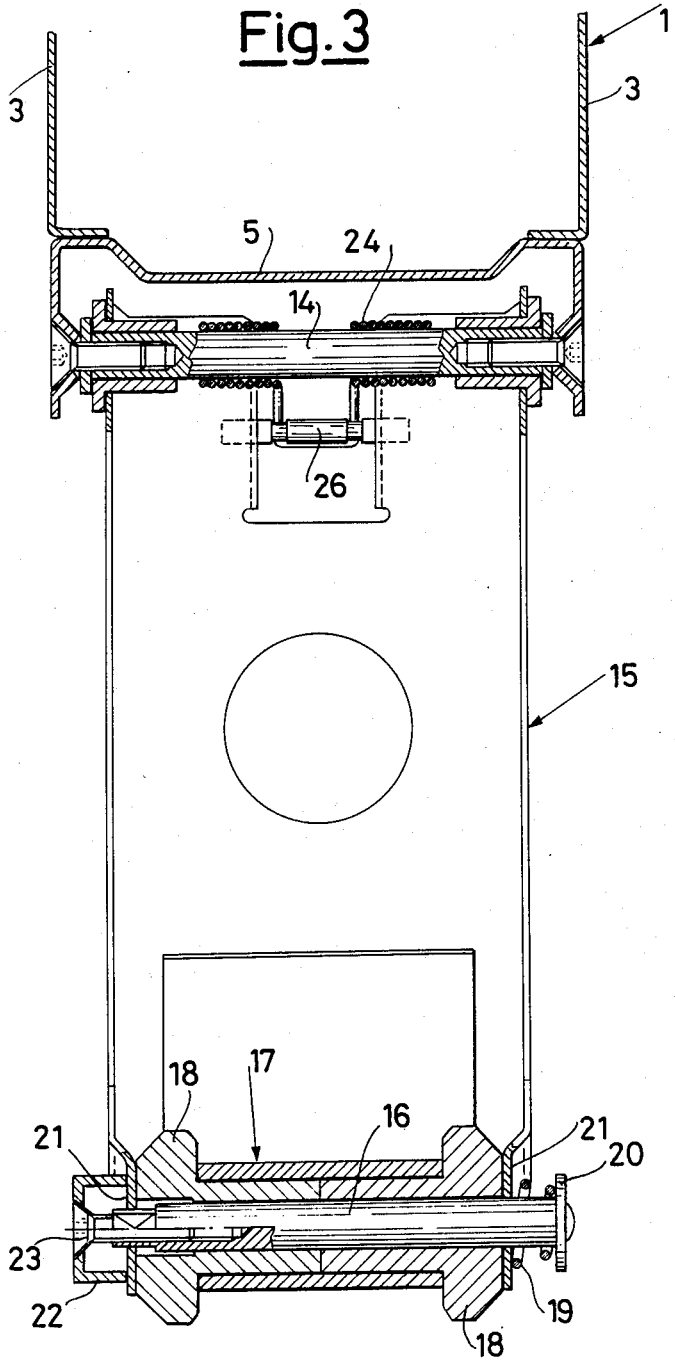
FIG. 3 shows said feeder in cross section along plane III—III of FIG. 1.
Figure 4:
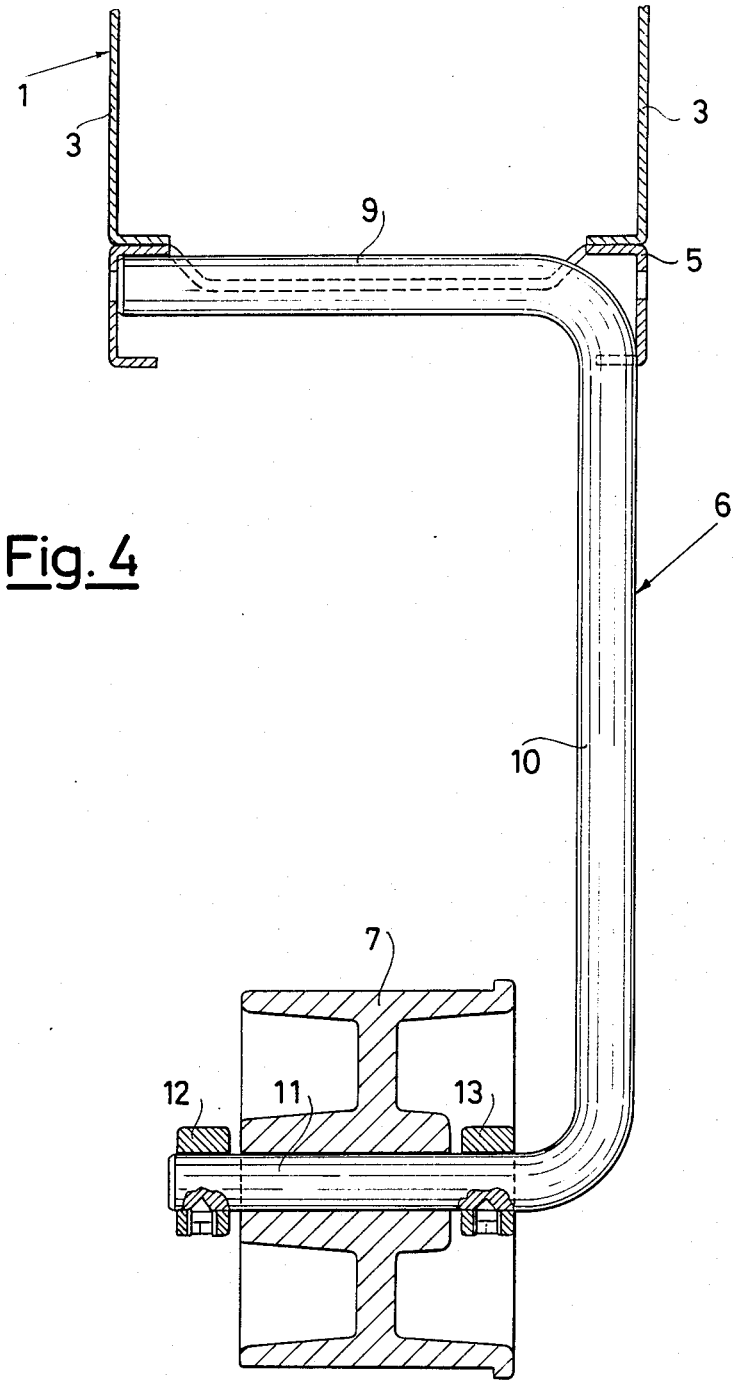
FIG. 4 shows said feeder in cross section along plane IV—IV of FIG. 1.

The feeder which supplies the adhesive tape 4 to the taping unit comprises in turn a supporting frame 5 fixable to the base of the sides 3 of the taping unit (FIG. 3). From said frame 5 extends downward a supporting arm 6 for a supporting roller 7 for a roll of adhesive tape 8 which is illustrated in dot and dash lines in FIG. 1. As shown in FIG. 4 the supporting arm 6 is made up of a horizontal upper portion 9 fixed to the frame 5, of a vertical intermediate portion 10, and of a horizontal lower portion 11 on which the supporting roller 7 is mounted in a freely revolving manner and sliding axially between the stop elements 12 and 13.

As can be seen in FIGS. 1 and 3, the frame 5 bears a lever arm 15 with its fulcrum 14 which supports at its lower arm a rotation pivot 16 for a withdrawal roller equipped with sides 18 with intervening space equal to or slightly greater than the width of the tape 4. A spring 19 (FIG. 3 only) reacts between an end disk 20 of the pivot 16 and a side 21 of the lower end of the arm 15 to maintain braking of the withdrawal roller 17, in cooperation with a cylindrical head 22 fixed to the pivot 16 by a screw 23 and held by said spring 19 against the other side 21 of the lower end of the arm 15.

As will be appreciated, the application of braking action by the spring 19 to the roller 18 requires at least slight flexure of at least one of the sides 21 of the arm 15, so that the sides 21 press against the opposite sides 18 of the withdrawal roller 17.

A spring 24 is wound on the fulcrum 14 of the lever arm 15 and reacts between a fixed pawl 25 of the frame 15 and a pin 26 resting against the arm 15 (FIGS. 1 and 3) to flexibly thrust the lever arm 15 in such a manner as to hold the withdrawal roller 17 in tangential contact with the roll 8 which is in turn held between the sides 18 of the withdrawal roller 17.

During use the adhesive tape 4, which has an adhesive side 27 and a nonadhesive side 28, is unwound from the roll 8 with a constant angle of withdrawal determined by the tangential contact of the withdrawal roller 17 with the roll 8 and clearly independent of the diameters of the roll 8. At the same time centering of the tape 4 is ensured by the sides 18 of the withdrawal roller 17 (FIG. 2) and possible convexities and/or misalignments of the roll 8 are compensated by small axial slidings of the roller 7 which allow the perimeter of the roll 8 to remain between the sides 18 of the withdrawal roller 17.

I claim:

1. An adhesive tape feeder, particularly for a cardboard box-sealing machine taping unit, comprising:

a longitudinally-elongated support frame;

a supporting arm means having two opposite ends, said supporting arm means depending by one said end from a first site on said support frame;

a freely-revolvable roller arranged with a longitudinal axis of revolution thereof crosswise to said longitudinally-elongated support frame;

said support arm means supporting said roller at an opposite said end of said support arm means;

a roll of adhesive tape having an outer circumferential peripheral surface and a generally constant width extending longitudinally of said roll of adhesive tape;

said roll of adhesive tape being mounted on said roller for revolution therewith;

a lever having two opposite ends, said lever depending by one said end from a second site on said support frame, said second site being longitudinally spaced along said support frame from said first site;

a tape withdrawal roller arranged with a longitudinal axis of revolution thereof crosswise to said longitudinally-elongated support frame, said tape withdrawal roller including an axially central drum portion having a radially outwardly-facing circumferential peripheral surface flanked at axially opposite ends by respective circumferentially-extending flanges each having a greater radially outward extent than said radially outwardly-facing circumferential peripheral surface, said flanges being spaced axially apart along said tape withdrawal roller by a certain distance;

said tape withdrawal roller being disposed with said radially outwardly-facing circumferential peripheral surface thereof in facial contact throughout a substantial angle of circumferential extent thereof, with an outer face of a leading portion of adhesive tape as withdrawn tangentially from said roll of adhesive tape, with opposite ends of said leading portion being flanked by said flanges of said tape withdrawal roller;

spring means active between said support frame and said lever for resiliently biasing said radially outwardly-facing circumferential peripheral surface of said drum portion thereof against said outer circumferential peripheral surface of said roll of adhesive tape at a leading end withdrawal site;

stop element means provided and effective between said support arm means and said freely-revolvable roller for permitting a range of limited axial movement of said freely-revolvable roller along said longitudinal axis thereof, transversally of said support frame;

the difference between the length of said certain distance by which said flanges of said tape withdrawal roller are spaced apart and said constant width of said roll of adhesive tape being less than the maximum limited axial movement of said freely-revolvable roller permitted by said stop element means; and a braking means provided and effective between said tape withdrawal roller an said lever for braking revolution of said tape withdrawal roller.

2. The adhesive tape feeder of claim 1, further comprising:

a taping unit having two laterally opposite sides to which said support frame is mounted;

an idle roller means mounted on said taping unit with its longitudinal axis extending crosswise in relation to said longitudinal axis of said supporty frame at a site located downstream along a tape leading end withdrawal path from said tape withdrawal roller for progressively receiving adhesive tape of said leading end from said tape withdrawal roller and passing such tape from under to over said upport frame and onwards between said opposite sides of said taping unit.

* * * * *